United States Patent [19]

Koch et al.

[11] 4,135,453

[45] Jan. 23, 1979

[54] MOTORIZED BOGIE

[75] Inventors: Wilhelm Koch; Hans Jund, both of Heidelberg, Germany

[73] Assignee: BBC Brown, Boveri & Company, Limited, Baden, Switzerland

[21] Appl. No.: 742,848

[22] Filed: Nov. 18, 1976

[30] Foreign Application Priority Data

Dec. 6, 1975 [DE] Fed. Rep. of Germany ..... 2555031

[51] Int. Cl.[2] ..... B61C 3/00; B61C 9/44; B61C 9/52; B61F 3/04

[52] U.S. Cl. ..... 105/131; 105/108; 105/117; 105/132; 105/135; 105/136

[58] Field of Search ..... 105/29 R, 131, 132, 105/108, 117, 135, 136

[56] References Cited

U.S. PATENT DOCUMENTS

| | | | |
|---|---|---|---|
| 568,779 | 10/1896 | Lockwood | 105/131 X |
| 751,893 | 2/1904 | Aultman et al. | 105/29 R |
| 2,277,835 | 3/1942 | Alben | 105/131 |
| 3,626,862 | 12/1971 | Korn et al. | 105/131 |
| 3,830,166 | 8/1974 | Dieling et al. | 105/131 X |

FOREIGN PATENT DOCUMENTS

| | | | |
|---|---|---|---|
| 851432 | 10/1952 | Fed. Rep. of Germany | 105/132 |
| 1530026 | 7/1970 | Fed. Rep. of Germany | 105/132 |

*Primary Examiner*—Albert J. Makay
*Assistant Examiner*—Howard Beltran
*Attorney, Agent, or Firm*—Toren, McGeady and Stanger

[57] ABSTRACT

A driving bogie having at least one driving motor, a pair of driven wheel-and-axle units and an axle gear for each of the axles of the wheel-and-axle units rigidly connected with the bogie frame, is arranged with a hollow transmission shaft for the axle gear encircling the axle of a respective wheel-and-axle unit and with a hollow Cardan shaft rigidly connecting the hollow transmission shaft with the wheel-and-axle units through centering articulated couplings. The invention is particularly directed to the structure of the articulated couplings which are formed with a number of hinged levers and with ball joints at the ends of each of the levers, the number of the hinged levers being an even number greater than three, with half of the hinged levers being arranged in the direction of rotation of the coupling and with the other half of the hinged levers being arranged in the opposite direction.

8 Claims, 7 Drawing Figures

Fig. 1
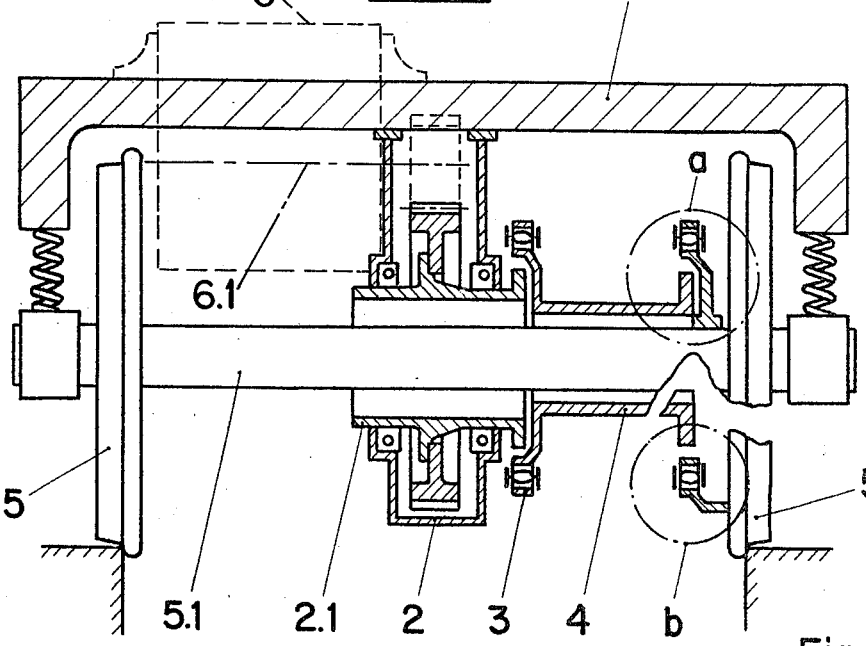
Fig. 1b
Fig. 2
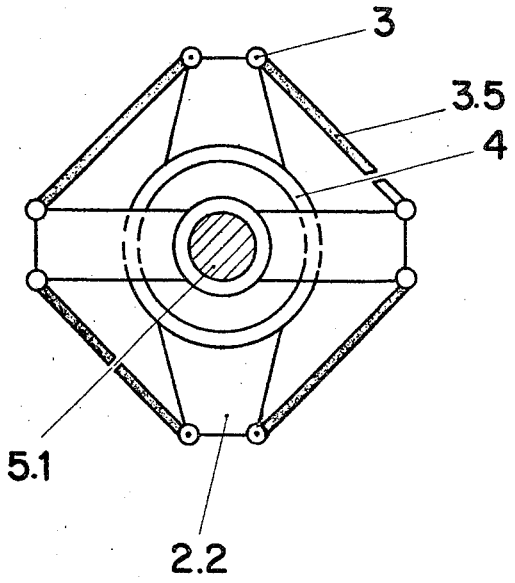

MOTORIZED BOGIE

BACKGROUND OF THE INVENTION

The present invention is generally concerned with the structure of a driving bogie for a tractive unit having at least one driving motor mounted in the bogie and at least two driven axles with each axle having an axle gear rigidly connected with the bogie frame. More particularly, the axle gear of the bogie has a hollow shaft embracing the respective driving axle upon which it is mounted and a hollow Cardan shaft rigidly connects the hollow transmission shaft and the driving axle and/or a driving wheel through centering articulated couplings.

Devices of the type to which the present invention relates are generally known in the prior art, for example, German DAS No. 1,530,026. In the articulated couplings provided in the known bogie arrangement, the joints of the two articulated couplings are designed as spherical joints. Such articulated couplings are formulated by statics, that is, without bracing forces appearing in the axial or Cardanic movements of the two shafts relative to each other and the restoring forces result only from the Cardanic movement of the ball joints of the hinged levers.

In a coupling which has four hinged levers, e.g. a so-called multiple link coupling, there appear compulsive forces in a Cardanic movement of the shafts relative to each other which are held within minimum limits by the use of rubber ball joints due to the radial contractability of the latter. If the hinged levers are arranged on the circumference in the same direction as in the known arrangement, no compulsive force appears during an axial movement of one shaft relative to the other. However, minimum rotation of the shafts relative to each other takes place in an axial movement. Such centric articulated couplings are, therefore, preferably used where a great deal of axial mobility of the shafts relative to each other is desired. In a case of axial deflection, an axial force occurs in a torque transmission due to the inclined position of the hinged lever. That is, the Cardan shaft must be guided axially at least by one of the articulated couplings.

In the articulated coupling with equidirectionally arranged hinged levers, all the hinged levers are stressed for tension, or all are stressed for compression, in the transmission of torque, depending on the direction of rotation. In case of tensile stress on the hinged levers, there occurs a stabilizing effect relative to the axial forces appearing in an axial displacement of the shafts since the reaction to the center increases with increasing torque. In a compressive stress, however, the deflecting axial force increases with increasing axial movement. Due to this difference regarding the different directions of rotation, the critical speed behavior and the amplitudes vary for the axial movements.

It is, therefore, an object of the present invention to provide an improved articulated coupling for bogie devices of the type described above. The object of the invention is to provide such improvement in a way that good Cardanic and axial mobility is maintained with central guidance of the shafts relative to each other. Furthermore, as an additional property of the articulated coupling, no axial force appears in axial and Cardanic deflections, and the critical speed behavior in the axial direction remains essentially the same relative to both directions of rotation. Additionally, a reduction in cost in the manufacture of ball joints may be achieved as a result of the present invention.

SUMMARY OF THE INVENTION

Briefly, the present invention may be described as a structure for the centered articulated couplings of a driving bogie for tractive units which has at least one driving motor arranged in the bogie and at least a pair of driven wheel-and-axle units with an axle gear being provided for each of the wheel-and-axle units rigidly connected with the bogie frame. The bogie includes a hollow transmission shaft for the axle gear embracing the axle of the respective wheel-and-axle unit and a hollow Cardan shaft frictionally connecting the hollow transmission shaft and the wheel-and-axle unit. Centering articulated couplings provide the connection between the hollow Cardan shaft and the hollow transmission shaft and the wheel-and-axle units. By a particular feature of the present invention the articulated couplings comprise a number of hinged levers with ball joints at their ends, said number of hinged levers being an even number greater than three, with one half of the hinged levers being arranged in the direction of rotation of the coupling and the other half being arranged in the opposite direction.

In accordance with the solution of the problems discussed above, provided by the present invention, the articulated couplings each have a hinged lever with ball joints at their ends, with n hinged levers being provided where n denotes an even number greater than three. Half the hinged levers are hinged in the direction of rotation of the coupling and the other half in the opposite direction. Such an articulated coupling will thus have at least four hinged levers where half are arranged in an opposite direction to the other hinged levers. In an axial movement of the shafts relative to each other, the hinged levers are deflected. The axial forces appearing in the transmission of torque, which are caused by the inclined position of the hinged lever, cancel each other out so that no axial forces act on the shaft and their bearings, and there is no excitation to an axial swing. In an axial and Cardanic movement of the two shafts relative to each other there is also no resulting axial force.

Since the conditions, that is, tensile and compressive stresses, are not changed by a reversal of the direction of rotation, there is no difference in the critical speed behavior of the arrangement according to the invention with different directions of rotation. By suitably dimensioning the length of the hinged levers and by fixing a distance of the fulcrums of the individual shafts, it is possible to provide much greater accuracy of angular synchronism in a Cardanic deflection than would be provided in a normal universal joint. In an axial movement of two shafts relative to each other, tensile forces will appear in one half of the hinged lever and there will be radial contraction of the rubber ball joints. However, an axial movement does not cause a rotary movement of the shafts relative to each other, so that no axial movements can be superposed upon rotary movements in the arrangement according to the present invention and ideal synchronisms are ensured in an axial movement. Due to the radial contraction of the rubber elements, however, the size of the axial mobility is limited. When this coupling is used in drives for tractive units, this axial mobility is deficient.

A further advantage of the arrangement according to the present invention involves that the drive-related coupling of the individual axles may be made of hard elastic, whereby the rotational elasticity of the coupling elements between the transmission and the hollow Cardan shaft is small. Thus, bracing paths of the axles relative to each other which are caused by blind moments resulting from the run of the wheel set, are so small that they come close to the continuous slip behavior of a single drive.

As a solution for further aspects of the problems sought to be overcome by the present invention, the ball joints of the hinged levers are each formed with a layer of rubber or rubber-like material arranged between a metal ring and a hollow spherical element. The rubber is vulcanized with the surfaces of the metal ring or hollow spherical element facing it and the parts projecting from the hollow spherical element on both sides of the layer pass over its conical lugs on which are placed the ends of a pair of hinged lever strips with a bore which is also conical with parts being pressed together by a bolt traversing the cavity of the hollow spherical element and a nut screwed on its threaded portion. With a joint design of this type it is possible to achieve a considerable reduction in manufacturing costs. The applicability of the joint is not limited to articulated couplings of electric tractive units and it also can be used in articulated couplings for coupling two shafts for any purpose.

By a further aspect of the present invention, the driving motor may be installed with the drive shaft perpendicular to the driving direction and the axle gear may be a spur gear. The Cardan shaft is, in this arrangement, of a rather large length, so that significant contraction is possible in the vertical direction of the axle.

In another embodiment of the invention, the motor is installed with the drive shaft extending along the driving direction, and the axle gear is a miter gear.

Finally, in a modification of an embodiment of the invention, the driving motor is so installed that the drive shaft forms an acute angle with the longitudinal axis of the vehicle and the axle gear is a miter gear. In this arrangement, the hollow Cardan shaft is also of substantial length so that a great deflection in the vertical direction of the axle is possible relative to the bogie.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings:

FIG. 1 is a sectional elevation taken through the axle of a bogie structure in accordance with the present invention and having a modification a;

FIG. 1*b* is a sectional view showing a modification b of the structure shown in FIG. 1;

FIG. 2 is a schematic representation of the articulated couplings of the invention;

DETAILED DESCRIPTION OF THE PREFERRED EMBODIMENTS

Figure 3:
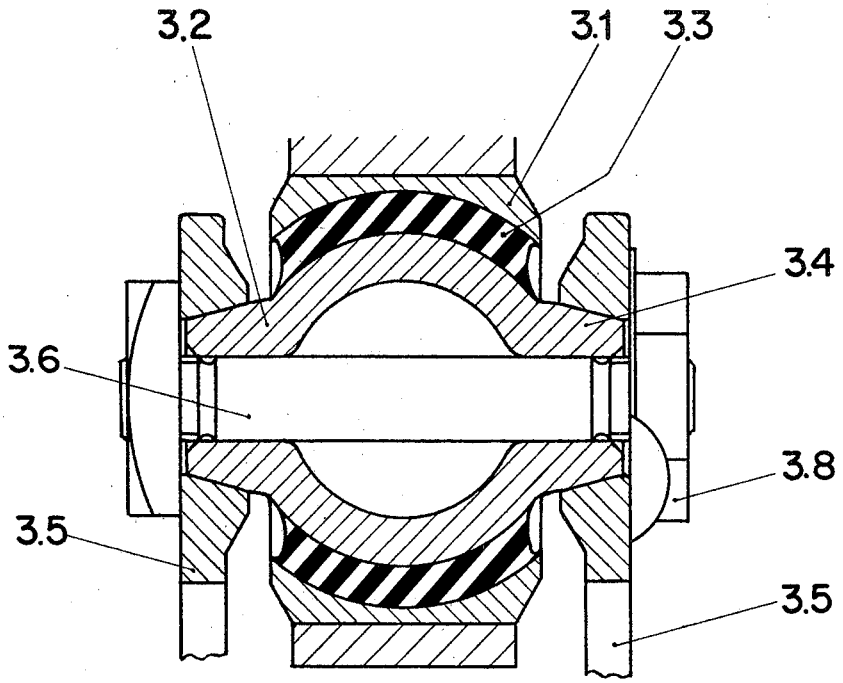
FIG. 3 is a sectional view taken through one of the joints of the articulated couplings.

Referring now to the drawings, wherein similar reference numerals identify similar parts throughout the various figures thereof, there is shown a bogie frame 1 having a transmission 2 with a hollow transmission shaft 2.1 and an articulated coupling 3. A hollow Cardan shaft 4 encircles the driving axle 5.1 of the bogie with a driving wheel 5 being attached to the axle 5.1 and with a driving motor 6 being provided for the bogie.

In the portion of the embodiment of the invention shown in FIG. 1, there is provided a spur gear and the driving motor 6 is installed with its axle 6.1 extending parallel to the axle 5.1. If the driving motor is installed with its axis parallel to the driving axle, the transmission may be arranged laterally, whereby there results a hollow Cardan shaft 4 having a substantial length. The power transmission from the hollow Cardan shaft may be effected directly to the driving axle as shown in FIG. 1 which embodies a modification a or, as shown in FIG. 1*b* which embodies a modification b, by connecting the Cardan shaft directly to the driving wheel.

In a detailed representation of the joint of the articulated coupling 3 (FIG. 3), an outer metal ring 3.1 extends about a substantially hollow spherical element 3.2 with a layer of rubber-like material 3.3 extending between the metal ring 3.1 and the hollow spherical element 3.2. The rubber-like layer 3.3 is vulcanized with the surfaces of the metal ring 3.1 and of the hollow spherical element 3.2 facing the layer 3.3. The hollow spherical element 3.2 has on its sides conical lugs 3.4 which project beyond the rubber layer 3.3. Upon the lugs 3.4 there are placed the ends of a pair of strips 3.5 of the hinged levers provided with bores, with the other ends acting on ball joints 3 arranged upon a flange 2.2 connected to the shaft to be coupled. The two hinged lever strips 3.5 are held together by a bolt passing through the hollow spherical element 3.2 which is pressed by a nut 3.8 against the hinged lever strips 3.5.

Figures 4A, 4B:
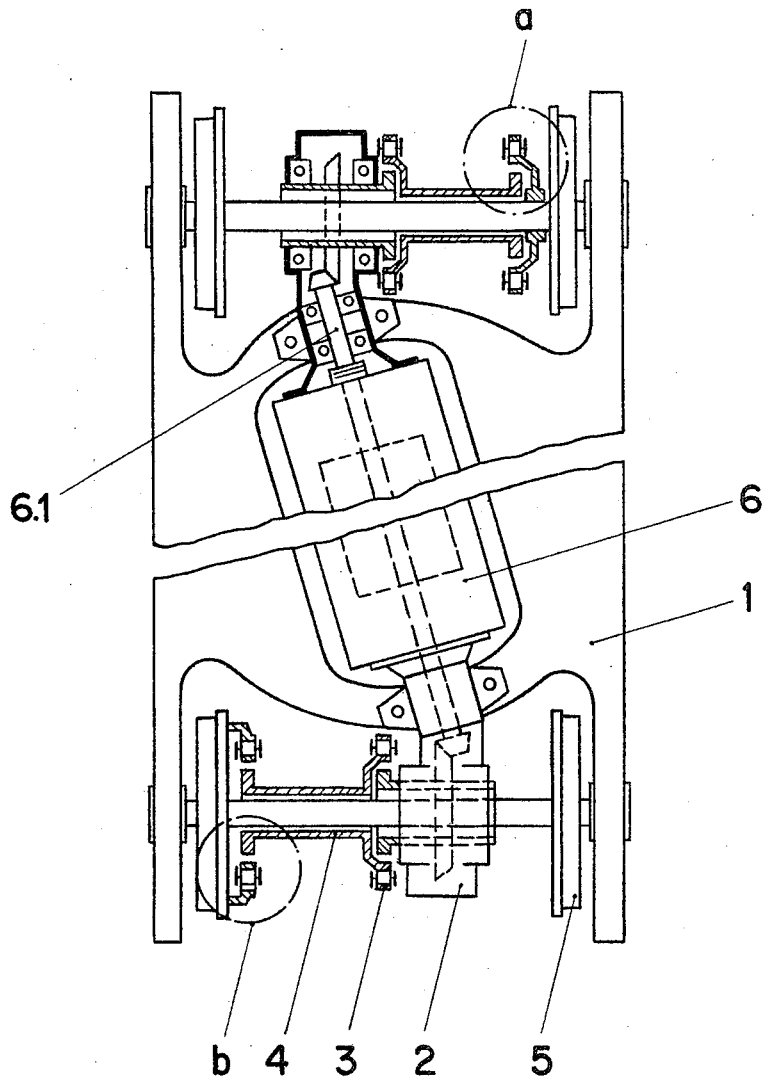
FIGS. 4*a* and 4*b* show in plan view a schematic representation of a portion of a bogie with a driving motor having an axle which is inclined relative to the longitudinal axis of the vehicle, with FIG. 4*a* being equipped with a modification a and FIG. 4*b* having a modification b.

In the embodiment represented in FIGS. 4*a* and *b*, the axle 6.1 of the driving motor 6 forms an acute angle with the longitudinal axis of the vehicle. In such an arrangement, it is also possible to obtain a great length of the Cardan shaft with a longitudinally arranged driving motor installed directly in the bogie. In the miter gear 2 the axis of the hollow shaft 2.1 and the axis 6.1 of the driving motor 6 form then an angle deviating from a right angle.

Figure 5:
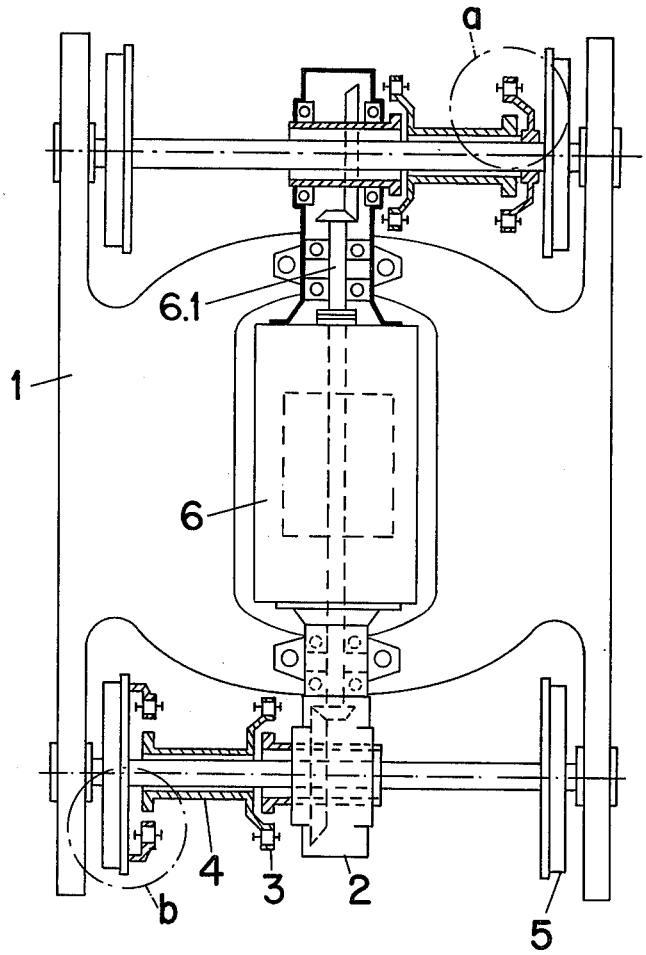
FIG. 5 shows in plan view a schematic representation of a bogie with a driving motor having an axle which is perpendicular to the axis of the vehicle with modification a being shown on one axle and mofification b being shown on the other axle.

FIG. 5 depicts the situation where the drive motor axle 6.1 is perpendicular to the driving axle, similar parts being identified with like reference numerals as in other figures of the drawings.

While specific embodiments of the invention have been shown and described in detail to illustrate the application of the inventive principles, it will be understood that the invention may be embodied otherwise without departing from such principles.

What is claimed is:

1. A transmission assembly for a vehicle including frame means, motive power means on said vehicle for driving said vehicle, and wheel-and-axle means having said frame means mounted thereon receiving power from said motive power means to effect movement of said vehicle, said transmission assembly being fixed to said frame means and connected between said motive power means and said wheel-and-axle means for transmitting motive power therebetween for driving said vehicle, said transmission means comprising hollow transmission shaft means arranged in generally coaxial relationship with the axle means of said wheel-and-axle means and having said axle means extending therethrough, hollow Cardan shaft means, and a pair of articulated coupling assemblies each comprising, respectively, a plurality of rigid levers and flexible joint means, with one of said coupling assemblies having its rigid levers interconnected at its ends by said flexible joint means between said transmission shaft and said Cardan shaft and with the other of said coupling assemblies having its rigid levers interconnected at its ends by said flexible joint means between said Cardan shaft means and said wheel-and-axle means, with said rigid levers being provided in each of said coupling assemblies in at least plural sets of plural levers, said levers being arranged such that when rotary motion is transmitted through said coupling assemblies one-half of said rigid levers in respective ones of said pair of coupling assemblies will be compressivly stressed with the complementary other half of said levers being tensively stressed, said flexible joint means being arranged at respective ends of each of said levers, each of said flexible joint means comprising an inner generally spherical element, an outer annular member and a resilient layer affixed therebetween.

2. A driving bogie according to claim 1, wherein said driving motor is installed in said driving bogie with its driving shaft extending perpendicular to the driving direction of said bogie and wherein said axle gear is a spur gear.

3. A driving bogie according to claim 1, wherein said driving motor is installed with its driving shaft extending parallel to the driving direction of said bogie and wherein said axle gear is a miter gear.

4. A driving bogie according to claim 1, wherein said driving motor is installed in a position whereby the driving shaft of said driving motor forms with the longitudinal axis of said bogie an acute angle and wherein said axle gear is a miter gear.

5. A transmission assembly according to claim 1 wherein said spherical element and said annular member of said flexible joint means define surfaces arranged in facing relationship, with said resilient layer being vulcanized with said surfaces, said hollow spherical element including parts projecting therefrom on both sides of said layer configured to form conical lugs upon which are placed the ends of a pair of said rigid levers, said rigid levers including a conical bore through which there is passed a bolt traversing the cavity of said hollow spherical element with a nut being screwed onto the threaded portion of said bolt.

6. A transmission assembly according to claim 1 including axle gearing interposed between said motive power means and said hollow transmission shaft means, said axle gearing being rigidly connected with said driving motor.

7. A transmission assembly according to claim 1 wherein the other of said coupling assemblies is arranged between said Cardan shaft means and said wheel-and-axle means to rotatably directly interconnect said Cardan shaft means with said axle means of said wheel-and-axle means.

8. A transmission assembly according to claim 1 wherein said other of said coupling assemblies is arranged between said Cardan shaft means and said wheel-and-axle means to rotatably directly interconnect said Cardan shaft means with said wheel means of said wheel-and-axle means.

* * * * *